US005381566A

United States Patent [19]

Sonesson et al.

[11] Patent Number: 5,381,566

[45] Date of Patent: Jan. 17, 1995

[54] BATHTUBS

[75] Inventors: Leif Sonesson, Eslöv; Jörgen Olsson, Malmö, both of Sweden

[73] Assignee: Arjo Hospital Equipment AB, Eslov, Sweden

[21] Appl. No.: 30,500

[22] PCT Filed: Oct. 24, 1991

[86] PCT. No.: PCT/SE91/00713

§ 371 Date: Apr. 1, 1993

§ 102(e) Date: Apr. 1, 1993

[87] PCT Pub. No.: WO92/07497

PCT Pub. Date: May 14, 1992

[30] Foreign Application Priority Data

Oct. 26, 1990 [SE] Sweden ..... 9003430-7

[51] Int. Cl.[6] ..... A47K 3/02; B08B 9/08; E04H 4/16

[52] U.S. Cl. ..... 4/591; 4/490

[58] Field of Search ..... 4/490, 591, 541.1-541.4, 4/662

[56] References Cited

U.S. PATENT DOCUMENTS

| | | | |
|---|---|---|---|
| 1,563,783 | 12/1925 | Paul | 4/591 |
| 4,383,341 | 5/1983 | Altman | 4/662 |
| 4,530,120 | 7/1985 | Etani | 4/490 X |

FOREIGN PATENT DOCUMENTS

| | | | |
|---|---|---|---|
| 1558947 | 3/1969 | France . | |
| 2491530 | 4/1982 | France . | |
| 3420714 | 12/1985 | Germany | 4/541.3 |
| 4108719 | 9/1992 | Germany | 4/541.3 |

*Primary Examiner*—Charles E. Phillips
*Attorney, Agent, or Firm*—Ladas & Parry

[57] ABSTRACT

An apparatus for first cleaning and thereafter rinsing a bathtub (10) by a cleaning liquid (60) and a rinsing liquid (61). Once the cleaning liquid has reached a predetermined level, the liquid is recycled via a suction extraction device (70) and is returned to the bath via a supply mechanism (11) disposed along the upper edge of the bathtub. Thereafter, the cleaning liquid is run off via a bottom outlet (13). The rinsing liquid (61) is supplied to the bath and recycled thereto via the suction extraction device (70) and the supply mechanism (11). A pump (40) is disposed to supply or discharge, via a conduit (23, 24), liquid from the bathtub. At least one (23) of the conduits is connected to the supply mechanism (11), and in addition control and regulation devices (50) are provided for starting and stopping the pump (40) and for adjusting the valve devices (41, 42, 43) to closed or opened positions for the supply of cleaning liquid or rinsing liquid to the bathtub.

19 Claims, 2 Drawing Sheets

BATHTUBS

FIELD OF THE INVENTION

The present invention relates to a method and an apparatus for cleaning bathtubs.

BACKGROUND

There are needs in this art to be able to supply liquid, as a rule water and/or cleaning liquid, to a bathtub in immediate association with the upper edge of the bathtub. In certain practical applications, the term cleaning liquid is taken to signify also liquid including disinfectant agents. Since the liquid is supplied in immediate association with the upper edge of the tub, complete cleaning of the tub will be facilitated, i.e. cleaning of all regions of the tub into which the bather may come into contact, or with which the bathing water may come into contact. In a medical care context, such a complete cleaning is a regularly recurring need. A distribution of the liquid supply such that this takes place along all parts of the upper edge of the tub also affords the advantage that, at peak working periods, cleaning of the bathtub may be postponed without the dirt/impurities coagulating on the surface of the bath, since there is the possibility of supplying liquid to the bathtub from time to time, thereby keeping the dirt/impurities damp. In order to achieve the above disclosed effects, it is necessary that the liquid be supplied in a uniform flow which covers all parts of the inner defining surface of the bathtub, so that the liquid, while on its passage towards the bottom and outlet of the tub, wets all parts of the inner surface of the bathtub.

For economic reasons, it is desirable that an apparatus for cleaning bathtubs supplies the cleaning liquid to the tub substantially fully automatically—as far as this is possible—and makes optimum use of the supplied cleaning liquid. Optimum utilization of the cleaning liquid requires that during each cleaning period only a minor volume of cleaning liquid is utilized, whereby contemplated environmental advantages will also be attained. In addition, it is necessary that the apparatus empties the bath of cleaning liquid and rinses the bath before the bath water is run into the bath.

SUMMARY OF THE INVENTION

An object of the invention is to provide apparatus wherein the above-established requirement and needs will be satisfied. The above and further objects of the invention are satisfied by an apparatus for cleaning a bathtub comprising an upper defining edge of the bathtub provided with supply means for selectively discharging cleaning liquid or rinsing liquid in a thin sheet from said edge along an inwardly facing defining surface of the tub, a pump, at least one conduit connecting the pump to a tap point from which liquid is supplied to the apparatus, at least one further conduit connecting the pump to the bathtub to supply or remove liquid from the bathtub, a preparation device for cleaning liquid connected to at least one of said conduits at least one of the further conduits, being connected to said supply means for discharging the liquid via said supply means into the bathtub, valve means provided in at least one of the further conduits and in said at least one conduit, and control and regulator means for starting and stopping the pump for supply of cleaning liquid or rinsing liquid to the bathtub.

BRIEF DESCRIPTION OF THE DRAWINGS

The present invention will now be described in greater detail hereinbelow, with particular reference to the accompanying drawings, in which.

DETAILED DESCRIPTION

Figure 1:
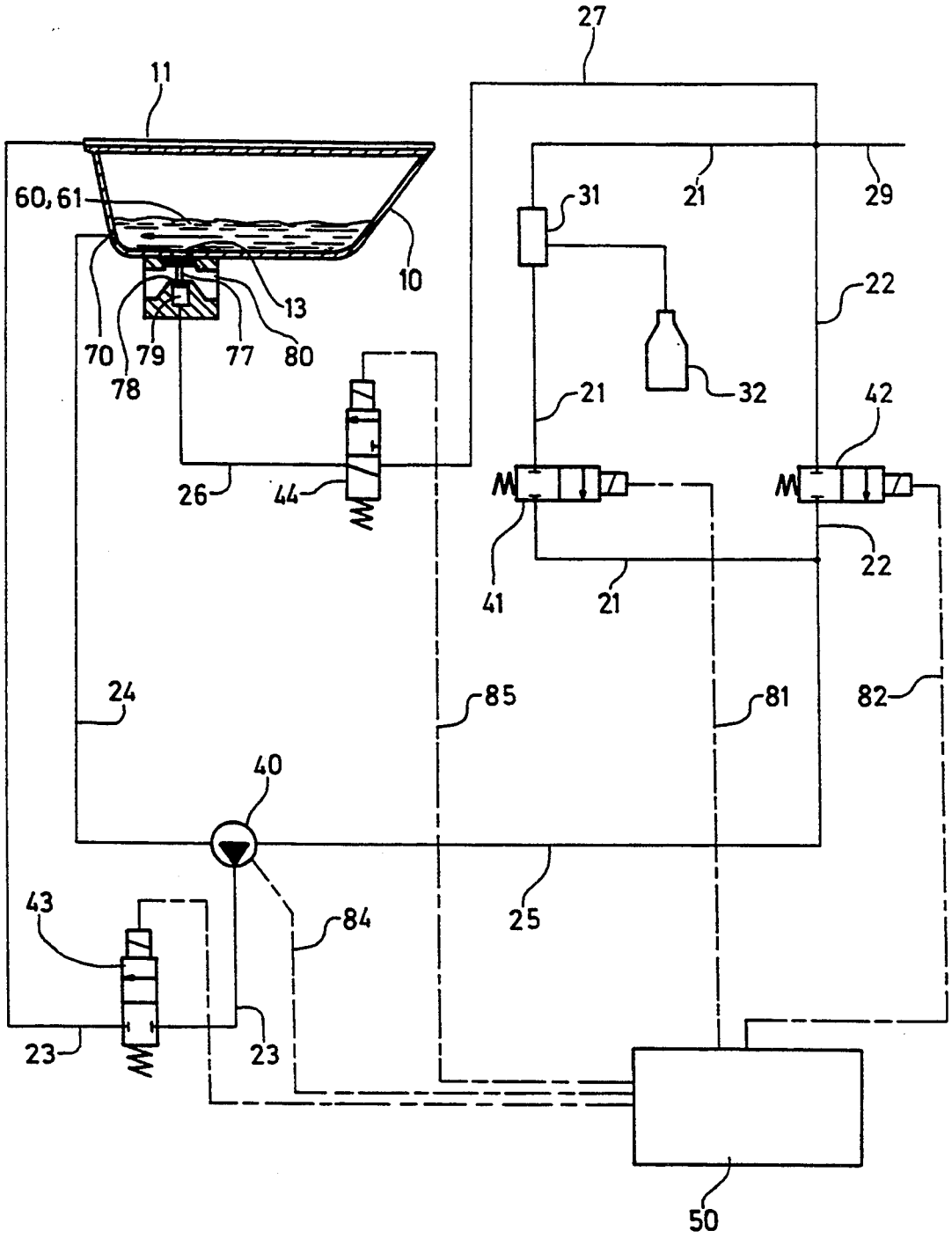
FIG. 1 is a schematic illustration of the apparatus according to the invention.

FIG. 1 shows one embodiment of the present invention in which a bath tub 10 is provided with a device 11 for discharging liquid to the bathtub in immediate association with the upper edge of the tub. Hereinafter, this device will generally be referred to as supply means 11. The tub is fitted with a bottom outlet 13 and with a passage 70 disposed to permit liquid to pass both into and out of the tub. Hereinafter, the designation suction extraction device 70, will be employed for the passage 70, since the device is primarily employed to remove liquid from the tub. The suction extractraction device is located relatively close to the bottom of the tub. One embodiment of the suction extraction device will be described in greater detail below with particular reference to FIG. 2. FIG. 1 also shows the tub filled with liquid to a level slightly exceeding the position of the suction extraction device 70. In FIG. 1, reference numerals 60 and 61 are used for the liquid, reference numeral 60 indicating that the liquid consists of cleaning liquid and reference numeral 61 indicating that the liquid consists of rinsing liquid.

Via a conduit system, the tub is connected to a tap point 29 for supply of liquid to the conduit system and thereby to the bath. The tap point is included in a pressurized liquid system, for example a municipal water mains system. A first conduit 21 and a second conduit 22 are connected to the tap point. A third conduit 23 connects the supply means 11 of the bathtub to a pump 40 by means of which a fourth conduit 24 is also connected to the suction extraction device 70 of the tub. A fifth counduit 25 connects the pump 40 to the tap point 29 via the first conduit 21 or the second conduit 22. Valves 41, 42 and 43 respectively, are provided in the first conduit 21, the second conduit 22 and the third conduit 23, the valves being switchable between open and closed positions. In FIG. 1, the valves are shown as solenoid valves, but it will be obvious to a person skilled in the art that any optional suitable type of valve may lend itself to application in the apparatus. The pump 40 may also be of different embodiments adapted to those particular requirements which may be placed on different embodiments of the present invention. In certain practical applications, the pump is disposed to permit, in the rest position, liquid to pass in any optional direction.

In the first conduit, there is disposed a device 31 for supplying cleaning liquid to the first conduit. Hereinafter, this device will be generally designated preparation device 31. In one preferred embodiment, the preparation device is designed as an ejector through which the liquid from the tap point 29 passes, at the same time as cleaning agent is supplied from a reservoir 32 connected to the ejector. It will be clear to the skilled reader of this specification that, in certain practical applications, the cleaning liquid is supplied directly to the first conduit from a system containing cleaning liquid, In such applications, the connection to the tap point 29 shown in the Figure is generally not required.

Cleaning of the bathtub 10 is commenced in that the first valve 41 is opened, liquid passing from the tap point 29 through the first conduit 21 and being supplied by the preparation device 31 with cleaning agent, whereafter the thus formed cleaning liquid is fed to the pump 40 via the fifth conduit 25. At the same time as the valve 41 is opened, the bottom outlet 13 of the bath tub is, as a rule, closed. On its passage through the preparation device, the liquid is supplied with cleaning agent, where applicable with an addition of disinfectant, so that cleaning liquid 60 is formed. Since the pump is not working, the cleaning liquid is forced through the pump, the fourth conduit 24 and the suction extraction device 70 so that the liquid is supplied to the bath tub.

When a predetermined quantity of cleaning liquid has accumulated in the bathtub, the third valve 43 is opened and the pump 40 is started, whereby cleaning liquid is sucked out of the tub through the extraction suction device 70, passes through the fourth counduit 24 to the pump 40 and is fed thereby through the third conduit 23 to the supply means 11. The cleaning liquid departs from the supply means in the form of a thin liquid sheet in immediate association with the defining surface of the upper bathtub edge facing towards the interior of the bathtub. Hereby, substantially all surface portions of the bathtub will be wetted and freed of impurities. Until such time as the first valve 41 has been closed, the pump is supplied with cleaning liquid also via the fifth conduit 25, for which reason the flow of cleaning liquid to the bathtub will be greater than the flow from the tub and, as a result, the quantity of cleaning liquid in the bathtub will increase. When this has reached the predetermined level, the first valve 41 is closed. The pump continues to work for a given time interval, whereafter the bottom outlet 13 of the bathtub is opened and the tub is emptied of cleaning liquid.

The second valve 42 is now opened, whereby the pump 40 is, via the second conduit 22 and the fifth conduit 25, supplied with rinsing liquid 61 from the tap point 29. The third valve 43 is also opened, whereby rinsing liquid is forced by the pump 40 through the third conduit 23 so that the liquid is fed to the supply means 11. In one preferred embodiment, the bottom outlet 13 is closed after a certain time and rinsing liquid accumulates in the bathtub. When the liquid level has reached the suction extraction device 70, the pump sucks rinsing liquid out of the bathtub via the suction extraction device 70 and returns extracted liquid to the supply means 11 via the third conduit 23, at the same time as the pump (and thereby the bathtub) is supplied with an additional flow of rinsing liquid from the tap point 29. Rinsing liquid which is fed to the supply means 11 departs therefrom in the form of a thin liquid sheet corresponding to that described above for the cleaning liquid in the preceding paragraph. Hereby, the inner surfaces of the bathtub will be rinsed as long as the pump is in operation. After a certain time, the outlet 13 of the bathtub is opened and the bathtub is emptied of rinsing liquid. The pump is also stopped.

The procedure, according to the preferred embodiment, of not closing the bottom outlet 13 until after a certain time has elapsed will ensure that, during the introductory rinsing period, a major part of the cleaning liquid will be removed from the tub. When rinsing liquid thereafter accumulates in the tub during the continued rinsing operation, the concentration of cleaning agent in the rinsing water will be so slight that any possible admixture of cleaning agent in the bathwater in subsequent filling of the bath will be negligible.

An operation cycle has been described in brief in the foregoing which is composed of one cleaning phase and one rinsing phase. It will, however, be obvious to a person skilled in the art that, in certain practical applications, this working cycle will be completed a plurality of times in order to achieve the contemplated cleaning effect.

The apparatus has been described above with one common conduit, the fifth conduit 25, which connects the pump 40 to the first conduit 21 and the second conduit 22. It will be obvious to a person skilled in the art that, in certain practical applications, the first conduit 21 and the second conduit 22 are connected directly to the pump.

In yet a further embodiment, the pump 40 is connected to the tap point 29 by means of but a single conduit, e.g. the first conduit 21. The preparation device 31 is, in such instance, disposed to be connected to the conduit or disconnected therefrom depending upon whether cleaning liquid or rinsing liquid is to be supplied to the bathtub.

In one alternative embodiment, the preparation device 31 is engagably and disangagably connected to the third conduit 23 in order to supply cleaning liquid or rinsing liquid in the application of a technique corresponding to that described in the preceding paragraph.

Figure 2:
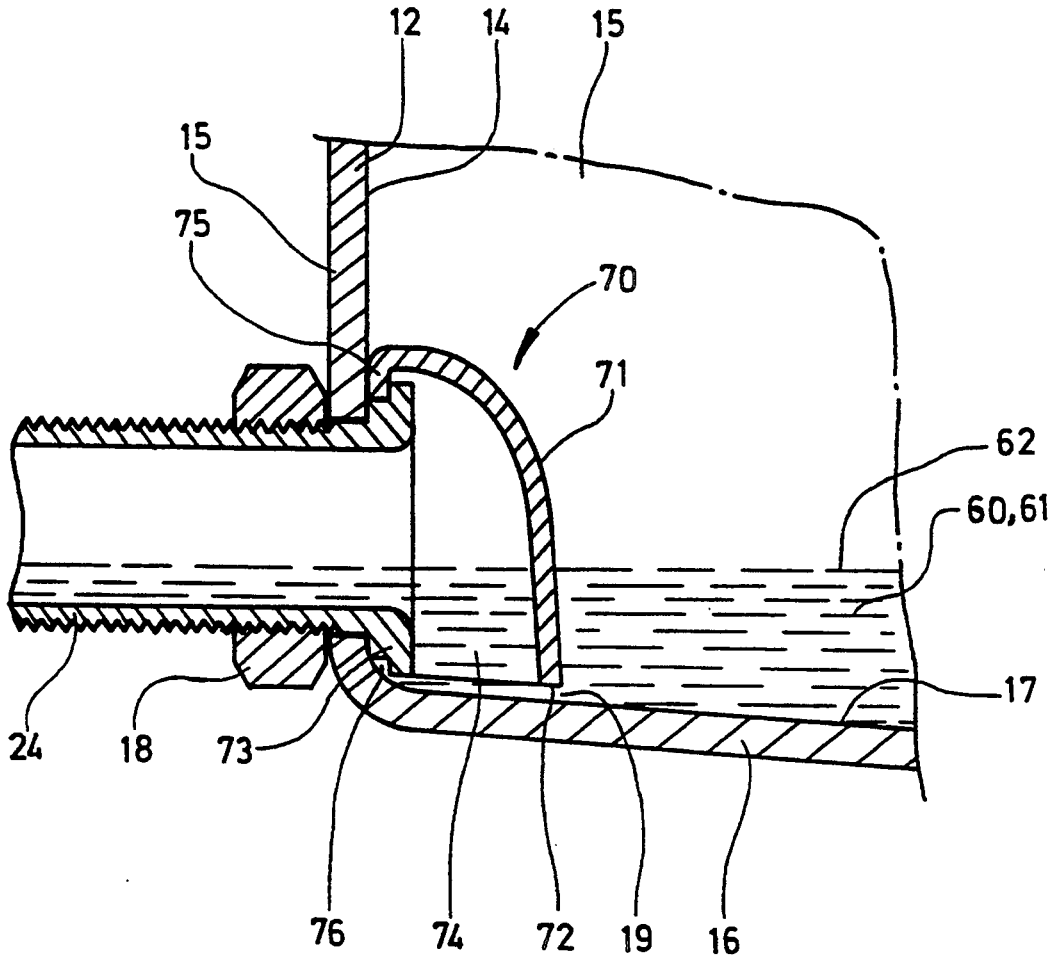
FIG. 2 is a detail of the apparatus which shows a suction extraction device an enlarged scale.

In order to achieve efficient utilization of the cleaning liquid and minimize time-loss during the cleaning operation, it is essential to be able to commence recycling of the liquid at an early stage. To this end, the suction extraction device 70 is, in one preferred embodiment, of the design and construction as illustrated in FIG. 2. The fourth conduit 24 has an end flange 73 which, with the conduit connected to the bathtub, abuts against the inner lateral defining surface 14 of the bathtub, as a rule in an area of the wall 15 thereof which is substantially planar. A recess 76 is provided in the flange and is adapted to the material thickness of a shield 71 which portion 75 located within the recess. As a rule, the recess is dimensioned so as to allow a certain clearance between the bent portion of the shield and the recess and the wall of the bathtub, respectively, whereby the shield is placed in the position illustrated in FIG. 2, by catching in the recess. After the insertion operation, the shield depends downwardly from the recess. By means of a nut 18 disposed on the opposite side of the wall, the flange 73 is drawn into abutment against the wall 15 of the bathtub so as to form a tight seal against the bathtub.

From the bent portion 75, the shield extends downwardly towards the bottom 16 of the bathtub in abutment against the wall of the tub to form a downwardly open space 74 which is defined by the shield 71, the flange 73 and the wall 15 of the tub. Between its lower edge 72 and the inner bottom defining surface 17 of the bathtub, the shield forms a gap 19 through which liquid passes into the space 74 between the shield 71, the flange 73 and the wall 15 of the bathtub and thence continues into the fourth conduit 24. The gap is located on a lower level than that level at which the conduit passes through the bathtub wall 15. In FIG. 2, the presence of cleaning liquid 60 or rinsing liquid 61 in the bathtub is also indicated. Reference numeral 62 indicates the position of the liquid surface. It will be obvious to a person skilled in the art that the quantity of liquid accumulated in the bathtub may be permitted to assume larger or smaller values, which naturally implies that the position of the liquid surface 62 is displaced upwardly or downwardly in FIG. 2.

By employing the shield 71, it is possible to connect the fourth conduit 24 to a part of the bathtub where the tub is defined by a substantially planar wall 15 without, at the same time, needing to suffer from the disadvantage that the liquid must be filled to a level where liquid reaches up to the mouth of the fourth conduit before it can be sucked out through the conduit. There will hereby be achieved the contemplated effect of being able at an early stage (i.e. already when there is but a slight quantity of liquid in the bathtub) to begin recirculation of liquid and consequential cleaning of the walls of the bathtub.

FIG. 1 also shows an embodiment of the bottom outlet 13 in which this is open during the initial stage of filling of liquid into the bathtub. A shut-off device 77 is disposed in the outlet, with a bottom portion 78 which forms a piston movably disposed in a cylinder 79. In its turn, the cylinder is connected, via a sixth conduit 26, to a fourth valve 44 which, via a seventh conduit 27, is connected to the tap point 29. With the piston in the upper position, the shut-off device 77 is disposed in a position for a closed outlet and, in the lower position, in a position for an open outlet. An outlet channel 80 is connected such that, with the shut-off device in an open outlet position, the outlet channel is in communication with the interior of the bathtub.

With the fourth valve 44 in the position illustrated in the FIG. 1, the cylinder 79 will be emptied of liquid, whereby the shut-off device 77 is opened. On closure, the fourth valve is set in that position in which the cylinder 79 is filled with liquid under pressure from the tap point 29 whereby the shut-off device 77 is displaced to its upper position, the outlet being closed. The shut-off device assumes this position until such time as cleaning liquid or rinsing liquid is to be run off from the bathtub, when the fourth valve 44 is switched over to the position shown in FIG. 1. Closing and opening of the outlet are thus regulated by hydraulic means, by switching off the fourth valve 44 and by utilizing liquid under pressure from the tap point 29.

One preferred embodiment of the present invention includes a control and regulator device 50 which, via a first signal communication line 81, is connected to the first valve 41, via a second signal communication line 82 to the second valve 42, via a third signal communication line 83 to the third valve 83, via a fourth signal communication line 84 to the pump 40, and via a fifth signal communication 85 to means for switching the bottom outlet 13 between open and closed position. As a rule, the control and regulator device 50 consists of a programmable unit which, via the signal communication lines, emits signals to each respective unit for opening or closing the valves, for starting or stopping the pump, or for opening or closing the bottom outlet of the bathtub. On programming, the cycle times are set for the cleaning phase and the rinsing phase, and also the part times for the different phases within each respective cycle. There will hereby be achieved simple control of the cleaning and rinsing process cycles, and the possibility for adaptation of these cycles to prevailing requirements. In simpler embodiments, the control and regulator device is disposed to be served at least in part manually.

It will be obvious to a person skilled in the art that the present invention offers a rational and simple technique for employment within, for example, hospitals, care facilities etc.

The above detailed description has referred to but a limited number of embodiments of the present invention, but it will be readily perceived by a person skilled in the art that the present invention encompasses a large number of embodiments within the spirit and scope of the appended claims.

We claim:

1. Apparatus for cleaning a bathtub having an upper edge, an interior surface and a lower outlet opening, said apparatus comprising:

supply means for discharging liquid in proximity to the upper edge of the bathtub in the form of a thin sheet of liquid which flows along the interior surface of the bathtub towards the lower outlet opening of the bathtub, a water tap for supply of water under pressure to the apparatus, said bathtub having a passage separate from said lower outlet opening, pump means for pumping liquid, conduit means for conveying liquid from said water tap to said passage and to said supply means, said conduit means connecting said pump means to said supply means, said water tap and said passage in the bathtub, valve means in said conduit means for controlling flow of liquid in said conduit means between said pump means, said supply means, said water tap and said passage in the bathtub, means for introducing cleaning liquid to said conduit means for supply of cleaning liquid to said supply means and to said passage in the bathtub, and control means connected to said valve means and to said pump means for selectively opening and closing said valve means and for selectively operating said pump means to achieve selective supply and extraction of water and cleaning liquid to and from said bathtub.

2. The apparatus as claimed in claim 1, wherein said control means operates said valve means and said pump means in successive stages in which 1) cleaning liquid is supplied to said passage to partially fill the bathtub, 2) supply of cleaning liquid is halted and the cleaning liquid is pumped by said pump means from the bathtub and resupplied thereto via said supply means, 3) cleaning liquid is removed from said bathtub via said outlet opening, and 4) water is pumped from said water tap to said supply means as a rinsing liquid for said bathtub.

3. The apparatus as claimed in claim 1, wherein said pump means includes an inlet, a pump outlet at which liquid is pumped from said pump means, and a discharge outlet at which liquid is discharged when the pump means is inoperative, said conduit means comprising a first conduit connecting said water tap and said inlet of said pump means, a second conduit connecting said pump outlet of said pump means and said supply means, and a third conduit connecting said discharge outlet of said pump means and said passage in said bathtub.

4. The apparatus as claimed in claim 3, wherein said means for introducing cleaning liquid is connected to supply the cleaning liquid to said first conduit.

5. The apparatus as claimed in claim 4, wherein said first conduit includes two branches connected in parallel to a common conduit, the branches being connected to said water tap, said common conduit connecting the branches to the inlet of the pump means.

6. The apparatus as claimed in claim 5, wherein said means for introducing cleaning liquid comprises a reservoir for cleaning liquid connected to one of said branches.

7. The apparatus as claimed in claim 6, wherein said valve means comprises a respective valve in each of said branches.

8. The apparatus as claimed in claim 7, wherein said valve means further comprises a further valve in said second conduit.

9. The apparatus as claimed in claim 3, comprising a shut-off means at said lower outlet opening of the bathtub, said shut-off means being connected to said water tap via a valve of said valve means which can be opened and closed for controlling opening and closing of said lower outlet opening by the pressure of the water at said water tap.

10. The apparatus as claimed in claim 9, wherein said shut-off means comprises a hydraulic piston and cylinder.

11. The apparatus as claimed in claim 1, wherein said conduit means comprises a conduit connected to said passage in said bathtub, said apparatus further comprising a shield connected to said conduit and disposed within said bathtub to form a cover for an open end of said conduit, said cover enclosing said open end of the conduit and forming a gap with a bottom surface of said bathtub for transfer of liquid between the bathtub and said conduit, said gap being at a level below said conduit.

12. The apparatus as claimed in claim 11, wherein said conduit includes an end flange forming a recess with the interior surface of the bathtub, said shield having a bent end engaged in said recess.

13. The apparatus as claimed in claim 12, wherein said shield is curved away from said open end of said conduit.

14. The apparatus as claimed in claim 13, wherein said conduit includes a threaded portion extending from said bathtub and a retaining nut on said threaded portion bearing externally against said bathtub and tightening said bent end of the shield in said recess.

15. An apparatus for cleaning a bathtub, comprising an upper defining edge of the bathtub provided with supply means for selectively discharging cleaning liquid or rinsing liquid in a thin sheet from said edge along an inwardly facing defining surface of the bathtub; said bathtub having a lower outlet; a pump; a first conduit connecting the pump to a tap point from which liquid is supplied to the apparatus; second and third conduits respectively connecting the pump to the supply means and to a passage in the bathtub separate from said lower outlet of the bathtub to supply liquid to the supply means and to supply or remove liquid from the bathtub via said passage; a preparation device for cleaning liquid connected to said first conduit; valve means for controlling liquid flow provided in said third conduit and in said first conduit; and control and regulator means for starting and stopping the pump and for operating the valve means between closed or opened positions for supply of cleaning liquid or rinsing liquid to the bathtub.

16. The apparatus as claimed in claim 15, wherein said preparation device is disposed in said at least one conduit connecting the pump to the tap point.

17. The apparatus as claimed in claim 15, wherein said third conduit connects the pump to said passage in the bathtub, said third conduit being connected within the bathtub to a shield directed towards a bottom of the bathtub, said shield forming, together with a bottom defining surface of the bathtub, a gap for passage of liquid to and from the third conduit, said gap being disposed at a lower level than a level at which the third conduit passes through the bathtub.

18. Apparatus for cleaning a bathtub having an upper edge, an interior surface, and a lower outlet opening, said apparatus comprising:

supply means for discharging liquid in proximity to the upper edge of the bathtub in the form of a thin sheet of liquid which flows along the interior surface of the bathtub towards the lower outlet opening of the bathtub, a water tap for supply of water under pressure to the apparatus, said bathtub having a passage separate from said lower outlet opening, a plurality of conduits connecting said water tap to said supply means, said passage and said lower outlet opening, a reservoir for cleaning liquid, said plurality of conduits including:

a first conduit connecting said supply means to said water tap, a second conduit connecting said passage to said water tap, a third conduit connecting said outlet opening to said water tap, a fourth conduit connecting said reservoir to said water tap, valves respectively in said first, second, third and fourth conduits to control flow of liquid in the respective conduits, control means connected to said valves to open and close the valves for controlling flow of liquid in the respective conduits, a) to supply water to said supply means selectively with or without cleaning liquid, b) to supply water to said passage selectively with our without cleaning liquid, and c) to supply water to said outlet opening to backwash the bathtub, and a pump connected to said first, second and third conduits, said control means being connected to said pump to selectively operate the pump and the valves in the conduits to suction liquid by the pump from the tub via said passage and pump the suctioned water to the supply means via said first conduit.

19. Apparatus as claimed in claim 18, comprising a shut-off device at said outlet opening connected to said fourth conduit, said shut-off device normally being open to permit outflow of liquid from said tub and being closed under the pressure of the water at said water tap when the valve in said fourth conduit is open.

* * * * *